US009833888B2

(12) United States Patent
Lambert

(10) Patent No.: US 9,833,888 B2
(45) Date of Patent: Dec. 5, 2017

(54) CLIP INSTALLATION TOOL

(71) Applicant: Toyota Motor Engineering & Manufacturing North America, Inc., Erlanger, KY (US)

(72) Inventor: Jeffrey D. Lambert, Georgetown, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 62 days.

(21) Appl. No.: 14/687,822

(22) Filed: Apr. 15, 2015

(65) Prior Publication Data

US 2016/0303720 A1 Oct. 20, 2016

(51) Int. Cl.
*B25B 27/20* (2006.01)
*B25B 31/00* (2006.01)

(52) U.S. Cl.
CPC ..... *B25B 31/00* (2013.01); *Y10T 24/30* (2015.01); *Y10T 24/45236* (2015.01); *Y10T 29/49826* (2015.01); *Y10T 29/53909* (2015.01)

(58) Field of Classification Search
CPC ..... B25B 27/20; Y10T 29/49826; Y10T 29/53909; Y10T 24/30; Y10T 24/45236
See application file for complete search history.

(56) References Cited

U.S. PATENT DOCUMENTS

| | | | | |
|---|---|---|---|---|
| 3,087,235 | A * | 4/1963 | Porter | H01R 43/22 29/278 |
| 3,965,776 | A | 6/1976 | Wolstenholme et al. | |
| 4,765,029 | A * | 8/1988 | Rogan | A22C 7/00 425/298 |
| 7,222,404 | B1 | 5/2007 | Lindsey et al. | |
| 7,637,527 | B2 | 12/2009 | Mazanek et al. | |
| 8,474,107 | B2 | 7/2013 | Baumgartner et al. | |
| 2008/0028577 | A1 * | 2/2008 | Soman | F16B 21/075 24/293 |

* cited by examiner

*Primary Examiner* — John C Hong

(74) *Attorney, Agent, or Firm* — Christopher G. Darrow; Darrow Mustafa PC

(57) ABSTRACT

An installation tool for a two-stage clip is described. The tool includes a base element and a plunger element. The base element can include a plunger installation cavity and a clip receiving cavity. At least a portion of the plunger element can be retainably engaged in base element. The plunger element can be movable within the base element between a retracted position and an extended position. In the extended position, a portion of the plunger element can extend into the clip receiving cavity.

17 Claims, 4 Drawing Sheets

CLIP INSTALLATION TOOL

FIELD

The subject matter described herein relates in general to the joining two or more structures together using a fastener and, more particularly, to tools for facilitating the installation of such fasteners.

BACKGROUND

Trim is used in some automobiles for cosmetic reasons to provide a more pleasing aesthetic appearance. For instance, trim may be used to cover portions of a vehicle frame. The trim can include a plastic or metal cover. The trim can be attached to the vehicle frame or other structure by clips. The clips may be installed by pushing on the clip with using a finger or another object.

SUMMARY

In one respect, the subject matter described herein is directed to a clip installation tool. The clip installation tool includes a base element and a plunger element. The base element can include a plunger installation cavity and a clip receiving cavity. At least a portion of the plunger element can be retainably received in base element. The plunger element can be movable within the base element between a retracted position and an extended position. In the extended position, a portion of the plunger element can extend into the clip receiving cavity.

In another respect, the subject matter described herein is directed to a clip installation tool. The clip installation tool can include a base element and a plunger element. The base element can include a plunger installation cavity and a clip receiving cavity. The base element can include a passage connecting between the plunger installation cavity and the clip receiving cavity. The clip receiving cavity can be configured to retainably engage a two-stage clip. At least a portion of the plunger element can be retainably received in base element. The plunger element can be movable within the base element between a retracted position and an extended position. A portion of the plunger element can extend into the clip receiving cavity in the extended position. The plunger element can include a pad portion and a shaft portion. The pad portion can be transverse to the shaft portion.

In still another respect, the subject matter described herein is directed to a method of installing a two-stage clip using a clip installation tool. The two-stage clip can include a first stage and a second stage. The clip installation tool can include a base element and a plunger element. The base element can include a plunger installation cavity and a clip receiving cavity. At least a portion of the plunger element can be retainably received in base element. The plunger element can be movable within the base element between a retracted position and an extended position. A portion of the plunger element can extend into the clip receiving cavity in the extended position.

The method can include bringing together the clip installation tool and the two-stage clip such that the second stage of the two-stage clip is retainably received within the clip receiving cavity of the installation tool. The method can also include inserting the first stage of the two-stage clip into substantially aligned apertures of two or more vehicle components. The method can further include activating the first stage of the two-stage clip using the clip installation tool.

DETAILED DESCRIPTION

Figure 1:
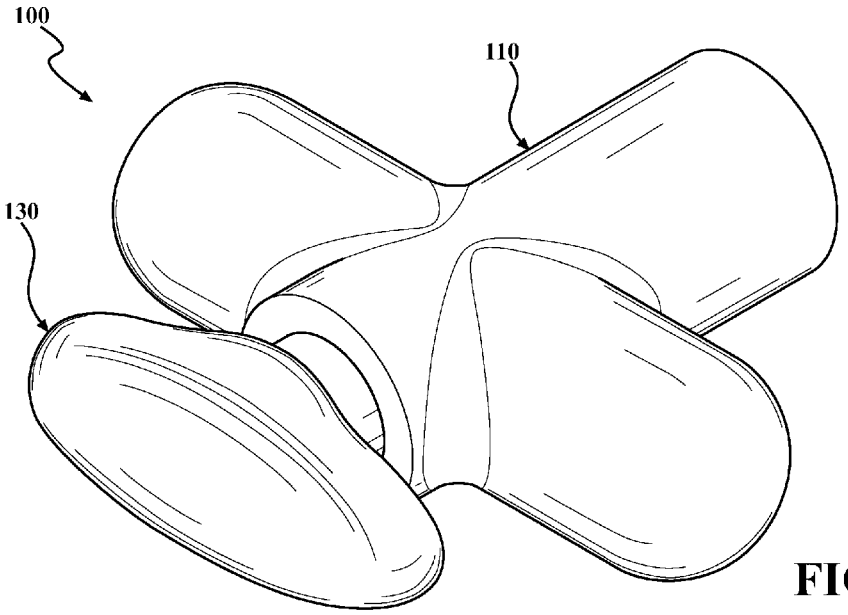
FIG. 1 is an example of a clip installation tool.

This detailed description relates to clip installation tools and the use of such tools. More particularly, the clip installation tool can include a base element and a plunger element. The base element can include a clip receiving cavity to receive a clip (e.g., a two-stage clip) therein. At least a portion of the plunger element can be retainably received in base element. The plunger element can be movable within the base element between a retracted position and an extended position. In the extended position, a portion of the plunger element can extend into the clip receiving cavity. Such a portion of the plunger element can engage a second stage of the clip so as to activate a first stage of the clip. The present detailed description relates to apparatuses, systems, and methods that incorporate one or more of such features. In at least some instances, such apparatuses, systems, and methods reduce or eliminate ergonomic strain on a human finger when installing a clip and/or can facilitate transport or handling of the clip.

Detailed embodiments are disclosed herein; however, it is to be understood that the disclosed embodiments are intended only as exemplary. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-7, but the embodiments are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details.

Referring to FIG. 1, an example of a clip installation tool 100 is shown. The clip installation tool 100 can have a base element 110 and a plunger element 130. The plunger element 130 can be separate from the base element 110. Each of these elements will be described in turn below.

Figure 2:
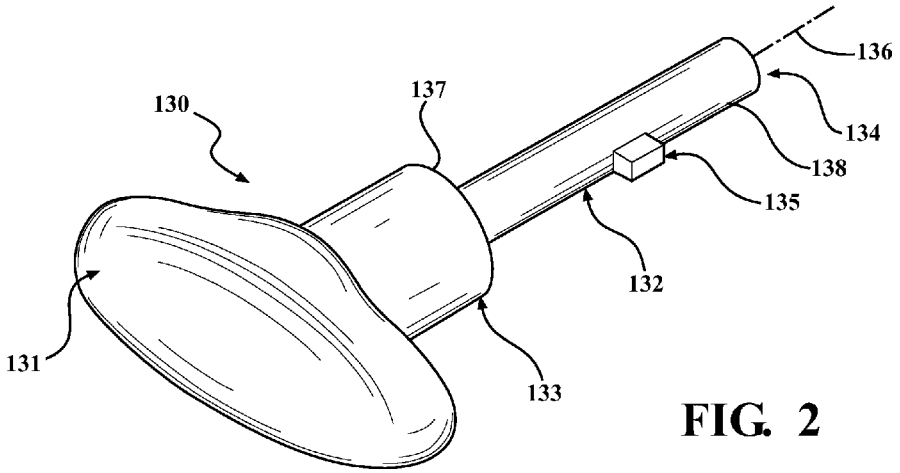
FIG. 2 is an example of a plunger element of the clip installation tool.

Referring to FIG. 2, an example of the plunger element 130 is shown. The plunger element 130 can have any suitable configuration. For instance, the plunger element 130 can have a pad portion 131 and a shaft portion 132. In one or more arrangements, the pad portion 131 and the shaft portion 132 can be formed as a single piece. In one or more arrangements, the pad portion 131 and the shaft portion 132 can be formed as separate pieces and operatively connected to each other. The term "operatively connected," as used throughout this description, can include direct or indirect connections, including connections without direct physical contact. For instance, the pad portion 131 and the shaft portion 132 can be operatively connected to each other by one or more adhesives, one or more fasteners, and/or one or more forms of mechanical engagement, just to name a few possibilities.

There can be any suitable transition between the pad portion 131 and the shaft portion 132. In one or more arrangements, a shoulder 137 can be defined between the pad portion 131 and the shaft portion 132. The shoulder 137 can be formed in any suitable manner. As an example, the plunger element 130 can include an intermediate portion 133.

The intermediate portion 133 can have any suitable form. In one or more arrangements, the intermediate portion 133 can be substantially cylindrical, but it will be understood that other shapes are possible, including, for example, substantially rectangular, substantially triangular, substantially polygonal or irregular. As used herein, the term "substantially" includes exactly the term it modifies and slight variations therefrom. Thus, the term "substantially cylindrical" means exactly cylindrical and slight variations therefrom.

The intermediate portion 133 can be located between the pad portion 131 and the shaft portion 132. In one or more arrangements, the intermediate portion 133 can be formed with the pad portion 131 or the shaft portion 132 as a unitary construction. In one or more arrangements, the intermediate portion 133, the pad portion 131, and the shaft portion 132 can be formed as a unitary structure. In one or more arrangements, the intermediate portion 133 can separate from the pad portion 131 and/or the shaft portion 132. In such instances, the intermediate portion 133 can be operatively connected to the pad portion 131 and/or the shaft portion 132 in any suitable manner, such as by one or more adhesives, one or more fasteners, and/or one or more forms of mechanical engagement, just to name a few possibilities.

The intermediate portion 133 can have an associated diameter. The shaft portion 132 can have an associated diameter. In one or more arrangements, the diameter of the intermediate portion 133 can be greater the diameter of the shaft portion 132.

The pad portion 131 can have any suitable form. The pad portion 131 can be configured to be engaged by a portion of the hand of a user (e.g., a person). More particularly, the pad portion 131 can be configured to be engaged by at least a portion of the palm of a user. In one or more arrangements, the pad portion 131 can be padded. In one or more arrangements, the pad portion 131 can include one or more ergonomic features to facilitate a user's engagement with the plunger element 130. The pad portion 131 can be made of one or more suitable materials. For instance, at least a portion of the pad portion 131 can be made of a flexible, soft, and/or gel material.

The shaft portion 132 can have any suitable configuration. In one or more arrangements, the shaft portion 132 can be substantially straight. The shaft portion 132 can have an associated longitudinal axis 136. In one or more arrangements, the shaft portion 132 can include one or more non-straight features, including one or more bends, curves, steps, etc.

In one or more arrangements, the pad portion 131 can extend in a direction that is generally transverse to the shaft portion 132. In one or more arrangements, the shaft portion 132 can extend at substantially 90 degrees relative to the pad portion 131, as is shown in FIG. 2. However, the plunger element 130 is not limited to such an arrangement between the pad portion 131 and the shaft portion 132. Indeed, the shaft portion 132 can extend at any suitable angle relative to the pad portion 131.

The shaft portion 132 can have any suitable cross-sectional shape. For instance, the shaft portion 132 can have a substantially circular cross sectional shape. However, it will be understood that the cross-sectional shape of the shaft portion 132 is not limited to being substantially circular. Indeed, in one or more arrangements, the shaft portion 132 can be substantially oval, substantially rectangular, substantially polygonal, substantially triangular, or irregular, just to name a few possibilities.

The shaft portion 132 can have any suitable length. The cross-sectional size, shape, and/or area of the shaft portion 132 can be substantially constant along the length of the shaft portion 132. Alternatively, the cross-sectional size, shape, and/or area of the shaft portion 132 can vary along at least a portion of the length of the shaft portion 132. In one or more arrangements, the shaft portion 132 can extend from the pad portion 131 to a distal end 134. The term "distal" is used for convenience to indicate the relative location of the end of the shaft portion 132 with respect to the pad portion 131. However, it will be understood that use of the term "distal" is not intended to be limiting.

The distal end 134 can have any suitable configuration. In one or more arrangements, the distal end 134 can be substantially flat. In such case, the distal end 134 can be oriented at substantially 90 degrees or other suitable angle relative to the longitudinal axis 136. In one or more arrangements, the shaft portion 132 can taper, conical, and/or otherwise reduce in cross-sectional area at or near the distal end 134. In one or more arrangements, the distal end 134 can be rounded. The distal end 134 can be configured to engage a second stage of a two-stage clip, as will be described herein.

The shaft portion 132 can include a retention element 135. The retention element 135 can have any suitable size, shape, and/or configuration. In one or more arrangements, the retention element 135 can be substantially rectangular. While the retention element 135 is shown and described herein as being substantially rectangular, it will be understood that the retention element 135 is not limited to this configuration. Indeed, the retention element 135 can have any suitable size, shape, and/or configuration. In one or more arrangements, the shaft portion 132 can be substantially cylindrical, substantially polygonal, substantially triangular, substantially trapezoidal, or irregular, just to name a few possibilities. The retention element 135 can extend transversely from an outer peripheral surface 138 of the shaft portion 132. In one or more arrangements, the retention element 135 can extend at substantially 90 degrees relative to the outer peripheral surface 138 of the shaft portion 132.

However, it will be understood that the retention element 135 can extend at any suitable angle relative to the shaft portion 132.

The plunger element 130 can be made of any suitable material. For instance, the plunger element 130 can be made of nylon, acrylonitrile butadiene styrene (ABS), or other suitable polymer. The plunger element 130 can be made of a material that will minimize or avoid damage to a clip that is engaged by the plunger element 130, as will be described herein. In one or more arrangements, the plunger element 130 can be made of a single material. In one or more arrangements, the plunger element 130 can be made of a plurality of materials. For instance, the pad portion 131 can be made of a different material than the shaft portion 132 and/or the intermediate portion 133.

The plunger element 130 can be substantially solid. Alternatively, at least a portion of the plunger element 130 can be hollow.

Figure 3:
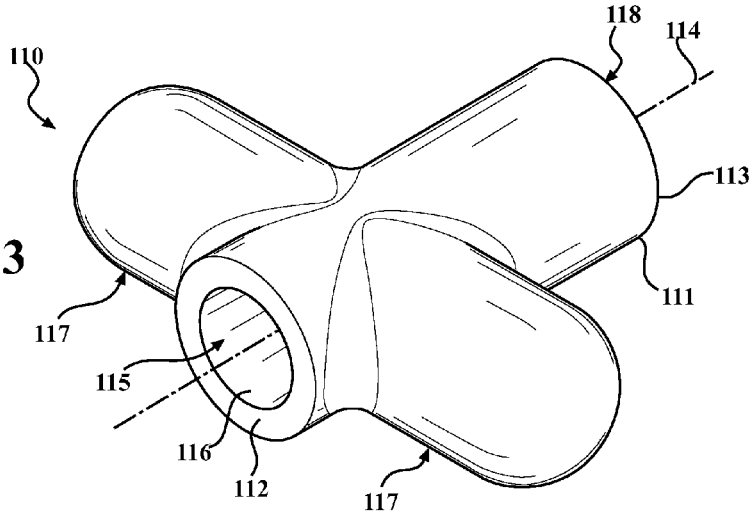
FIG. 3 is an example of a base element of the clip installation tool.
Figure 4:
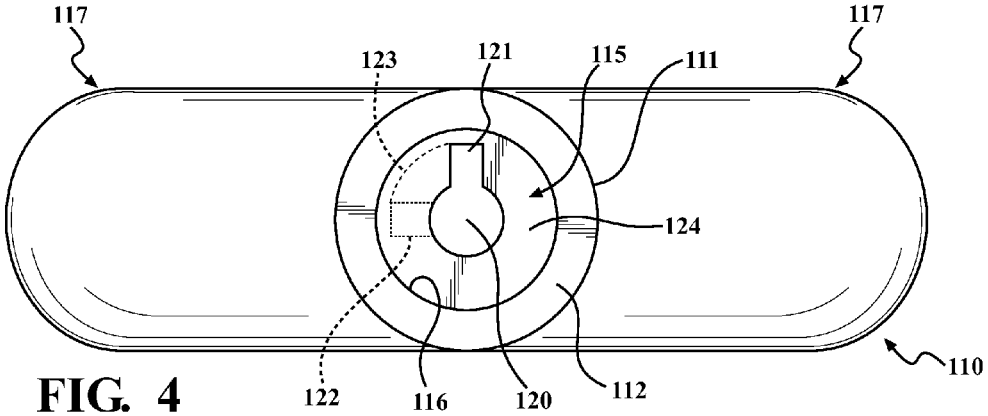
FIG. 4 is view of a first end of the base element of the clip installation tool, showing a plunger insertion cavity.
Figure 5:
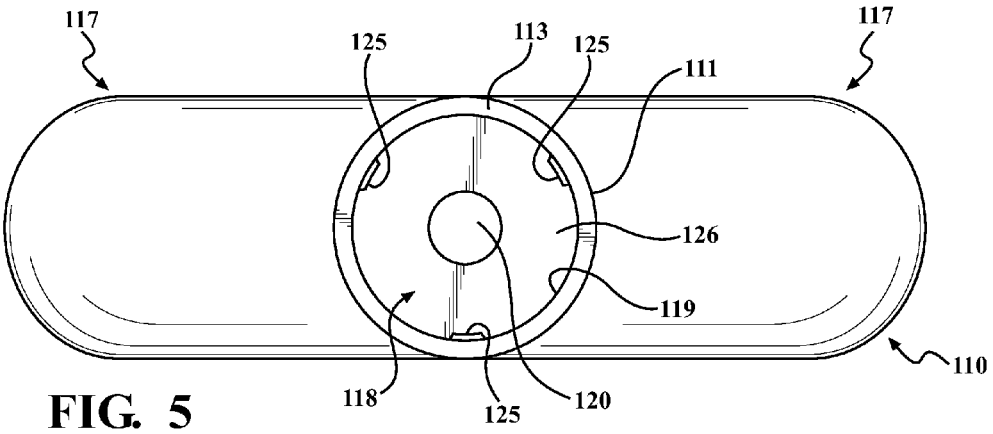
FIG. 5 is view of a second end of the base element of the clip installation tool, showing a clip receiving cavity.

As noted above, the clip installation tool 100 can include the base element 110. The base element 110 can have any suitable configuration. One example of the base element 110 is shown in FIGS. 3-5. In one or more arrangements, the base element 110 can have a main body 111. The main body 111 can have any suitable configuration. In one or more arrangements, the main body 111 can be substantially cylindrical, as is shown in FIG. 3. However, it will be understood that the main body 111 is not limited to being substantially cylindrical. Indeed, the main body 111 can have any suitable shape, including for example, substantially rectangular, substantially polygonal or substantially triangular, substantially oval, or irregular just to name a few possibilities.

The main body 111 can have a first end 112 and a second end 113. The first end 112 and/or the second end 113 can be substantially flat. In one or more arrangements, the first end 112 and the second end 113 can be substantially parallel to each other. The main body 111 can have a longitudinal axis 114.

A plunger insertion cavity 115 can be defined in the main body 111. The plunger insertion cavity 115 can be defined at least partially by an inner peripheral surface 116 formed in the main body 111. Alternatively or in addition, the plunger insertion cavity 115 can be defined at least partially by a bottom wall 124 formed in the main body 111 (see FIG. 4). The plunger insertion cavity 115 can open to the first end 112 of the main body 111, as is shown in FIGS. 3 and 4.

A clip receiving cavity 118 can be defined in the main body 111. The clip receiving cavity 118 can be defined at least partially by an inner peripheral surface 119 formed in the main body 111 (see FIG. 5). Alternatively or in addition, the clip receiving cavity 118 can be defined at least partially by a top wall 126 formed in the main body. The clip receiving cavity 118 can open to the second end 113 of the main body 111. In one or more arrangements, the clip receiving cavity 118 can be substantially cylindrical.

It will be appreciated that the terms "top" and "bottom," as used in connection with the top wall 126 and the bottom wall 124, are used merely for convenience to facilitate the description. However, it will be understood that arrangements are not limited by these terms. Indeed, the particular relative location of the walls 124, 126 can vary depending on the orientation of the clip installation tool 100.

The plunger insertion cavity 115 can have any suitable configuration to receive at least a portion of the plunger element 130 therein. More particularly, the plunger insertion cavity 115 can be sized, shaped, and/or otherwise configured to receive at least a portion of the intermediate portion 133 of the plunger element 130. The plunger insertion cavity 115 can also be configured to allow the shaft portion 132 to be received therein and/or pass therethrough.

In one or more arrangements, the inner peripheral surface 116 of the plunger insertion cavity 115 can be substantially cylindrical. However, it will be understood that the inner peripheral surface 116 of the plunger insertion cavity 115 can have any suitable size, shape, and/or conformation. Indeed, in one or more arrangements, the inner peripheral surface 116 can be substantially rectangular, substantially polygonal or substantially triangular, substantially oval, or irregular, just to name a few possibilities. In one or more arrangements, the shape of the plunger insertion cavity 115 can be substantially geometrically similar to the shape of at least a portion of the plunger element 130 (e.g., the intermediate portion 133).

As noted above, the plunger insertion cavity 115 can have a bottom wall 124. The bottom wall 124 can be configured to limit the motion of the plunger element 130 within the base element 110. In one or more arrangements, as will be described herein, the bottom wall 124 can be used to engage the shoulder 137 of the plunger element 130.

The clip receiving cavity 118 can have any suitable configuration to receive at least a portion of a fastener therein. More particularly, the clip receiving cavity 118 can be sized, shaped, and/or otherwise configured to receive at least a portion of a clip. Still more particularly, the clip receiving cavity 118 can be sized, shaped, and/or otherwise configured to receive at least a portion of a two-stage clip (e.g. the second stage of a two-stage clip) therein. The clip receiving cavity 118 can also be configured to receive at least a portion of the shaft portion 132, including the distal end 134 of the shaft portion 132.

In one or more arrangements, the inner peripheral surface 119 of the clip receiving cavity 118 can be substantially cylindrical. However, it will be understood that the inner peripheral surface 119 of the clip receiving cavity 118 can have any suitable size, shape, and/or conformation. Indeed, in one or more arrangements, the inner peripheral surface 119 can be substantially rectangular, substantially polygonal or substantially triangular, substantially oval, or irregular, just to name a few possibilities.

In one or more arrangements, the clip receiving cavity 118 can be configured to retainably engage a clip therein. In this context, "retainably engage" or "retainable engagement" means that the clip receiving cavity and a clip engage each other in such a way that allows the clip to held in the clip receiving cavity, while allowing the clip to be easily removed from the clip receiving cavity, such as by applying of a force to the clip. To that end, the clip receiving cavity 118 can have one or more features to facilitate such retainable engagement. For instance, the clip receiving cavity 118 can include one or more protrusions 125, as is shown in FIG. 5. The one or more protrusions 125 can project inwardly from the inner peripheral surface 119. The one or more protrusions 125 can have any suitable configuration.

There can be any suitable quantity of protrusions 125. In one or more arrangements, there can be a plurality of protrusions 125. In one or more arrangements, there can be three protrusions 125, as is shown in FIG. 5. In one or more arrangements, the protrusions 125 can spaced substantially equally about the inner peripheral surface 119 of the clip receiving cavity 118. The protrusions 125 can be substantially identical to each other at least in terms of size and/or shape. In one or more arrangements, one or more of the protrusions 125 can be different from the other protrusions 125 in one or more respects, including, for example, in terms of size and/or shape.

The protrusions 125 can be disposed at substantially the same point along the longitudinal axis 114 of the base element 110. The protrusions 125 can be located at substantially the same depth within the clip receiving cavity 118 with respect to the second end 113 of the base element 110. However, in one or more arrangements, one or more of the protrusions 125 can be disposed at a different point along the longitudinal axis 114 than the other protrusions 125.

One or more of the protrusions 125 can be formed with the base element 110 as a unitary structure. Alternatively, one or more of the protrusions can be formed separately and operatively connected to the base element 110 in any suitable manner.

The one or more protrusions 125 can be configured to retainably engage a clip in place within the clip receiving cavity 118. In one or more arrangements, the one or more protrusions 125 can be configured to retainably engage the clip within the clip receiving cavity 118 by frictional engagement.

The plunger insertion cavity 115 can be in communication with the clip receiving cavity 118 by a connecting passage 120. The connecting passage 120 can have any suitable configuration. In one or more arrangements, the connecting passage 120 can be substantially circular in cross-sectional shape. However, the connecting passage 120 can have other cross-sectional shapes. The connecting passage 120 can extend from the plunger insertion cavity 115 to the clip receiving cavity 118. The connecting passage 120 can be configured to receive at least a portion of the plunger element 130 (e.g., at least a portion of the shaft portion 132) therein.

As will be described in greater detail below, the connecting passage 120 can include a keyway 121 (FIG. 4). The keyway 121 can be in communication with a guide passage 122 (FIGS. 4, 6A and 6B) in the main body 111 of the base element 110. For instance, the keyway 121 can be in communication with the guide passage 122 by a transfer passage 123 (FIG. 4). In one or more arrangements, the guide passage 122 can be offset from the keyway 121 by about 90 degrees. The keyway 121 can extend along at least a portion of the length of the connecting passage 120. In one or more arrangements, the keyway 121 can extend from the plunger insertion cavity 115 to at least a guide passage 122 (see FIGS. 4, 6A, and 6B).

The base element 110 can include a handle 117. The handle 117 can extend generally transverse to the main body 111. The handle 117 can extend from opposite sides of the main body 111. In one or more arrangements, the handle 117 may extend from only one side of the main body 111. The handle 117 can have any suitable configuration. In one or more arrangements, the handle 117 can be substantially cylindrical. The handle 117 can have substantially hemispherical ends, as is shown in FIGS. 3-5. In one or more arrangements, the handle 117 can be substantially solid. In one or more arrangements, at least a portion of the handle 117 can be hollow.

The handle 117 can be configured to facilitate engagement by a user. More particularly, the handle 117 can be configured to facilitate engagement by at least a portion of a human hand. More particularly, the handle 117 can be configured for engagement by at least a portion of one or more human fingers. In one or more arrangements, the handle 117 can include grips, recesses, contours, and/or other ergonomic features to facilitate such engagement.

As will be described in more detail herein, the handle 117 can facilitate transport of the clip installation tool 100 by a user. The handle 117 can also facilitate user engagement with and/or activation of the clip installation tool 100.

The handle 117 can be formed together with the main body 111 as a unitary structure. Alternatively the handle 117 can be formed separately from the main body 111 and operatively connected thereto in any suitable manner, such as by one or more fasteners, one or more adhesives, one or more forms of mechanical engagement, one or more forms of welding, one or more forms of brazing, and/or any combination thereof.

The base element 110 can be made of any suitable material. For instance, the base element 110 can be made of nylon, acrylonitrile butadiene styrene (ABS), or other suitable polymer. In one or more arrangements, the base element 110 can be made of a single material. In one or more arrangements, the base element 110 can be made of a plurality of materials. The base element 110 can be made of the same material as the plunger element 130. Alternatively, the base element 110 can be made of a different material than the plunger element 130.

Now that the individual components of the clip installation tool 100 have been described, one manner of assembling the clip installation tool 100 will now be presented. The plunger element 130 and/or the base element 110 can be brought together. "Brought together" or "bringing together" means that the plunger element 130 and/or the base element 110 is manipulated so as to come proximate to and/or in contact with each other. The plunger element 130 and the base element 110 can be brought together such that the distal end 134 of the plunger element 130 can be received in the plunger insertion cavity 115 of the base element 110. More particularly, the plunger element 130 and the base element 110 can be brought together such that the distal end 134 of the plunger element 130 is received in the connecting passage 120 and such that the retention element is received in and/or aligned with the keyway 121.

The plunger element 130 can be moved generally in the direction of the longitudinal axis 114 of the base element 110 toward the second end 113. The plunger element 130 can be moved a sufficient distance such that the retention element 135 can be substantially aligned with the transfer passage 123 (FIG. 4). In such condition, the plunger element 130 and/or the base element 110 can be manipulated such that the retention element 135 is moved into the guide passage 122. For instance, the plunger element 130 can be rotated about the longitudinal axis 136. During such rotation, the retention element 135 can move from the keyway 121 and into the transfer passage 123. The rotation of the plunger element 130 can continue until the retention element 135 is received in the guide passage 122.

Once the retention element 135 is received in the guide passage 122, the plunger element 130 can be retainably engaged in the base element 110. "Retainably engaged" means that the plunger element and the base element are held together, while permitting movement of the plunger element within the base element, so that unintentional separation of the plunger element and the base element is reduced. In the arrangement described herein, the plunger element 130 and the base element 110 are retainably engaged as a result of the retention element 135 being received in the guide passage 122. It will be understood that this arrangement is merely one possible manner of configuring the base element 110 and/or the plunger element 130 for retainable engagement. However, other forms of retainable engagement are possible. It should be noted that, when the plunger element 130 is retainably engaged in the base element 110, the handle 117 can extend in substantially the same direction as the pad portion 131, as is shown in FIG. 1. When the plunger element 130 is retainably engaged in the base element 110, the plunger element 130 and the base element 110 can be selectively separated by a user by manipulating the plunger element 130 and/or the base element 110 such that the retention element 135 is moved out of the guide passage 122, through the transfer passage 123, and into the keyway 121.

When the retention element 135 is received in the guide passage 122, further movement of the plunger element 130 within the base element 110 is allowed in the direction of the longitudinal axis 136. The plunger element 130 can have any suitable range of motion. The plunger element 130 can include a retracted position and an extended position.

Figure 6A:
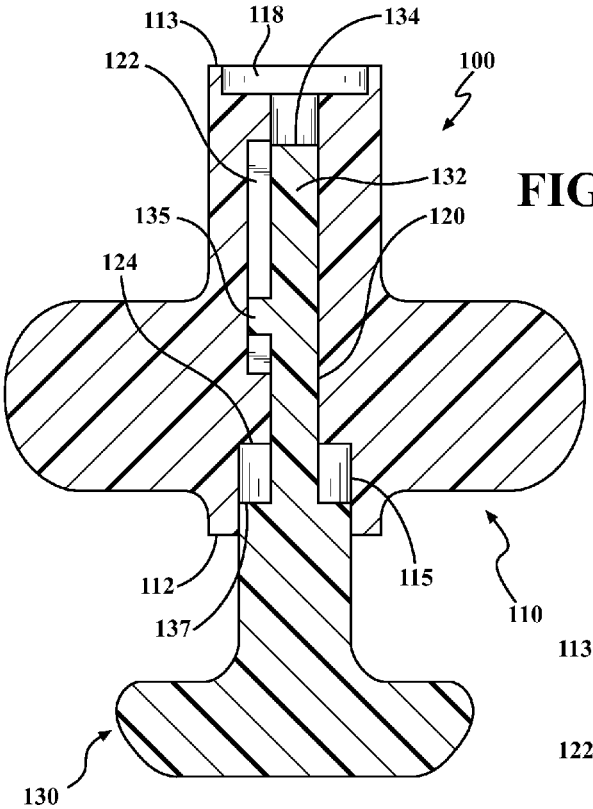
FIG. 6A is cross-sectional view of the clip installation tool, showing the plunger element in a retracted position.

FIG. 6A shows an example of the plunger element 130 in a retracted position. In the retracted position, the distal end 134 of the shaft portion 132 is not located within the clip receiving cavity 118. The shoulder 137 of the plunger element 130 is spaced from the bottom wall 124 of the plunger insertion cavity 115.

Figure 6B:
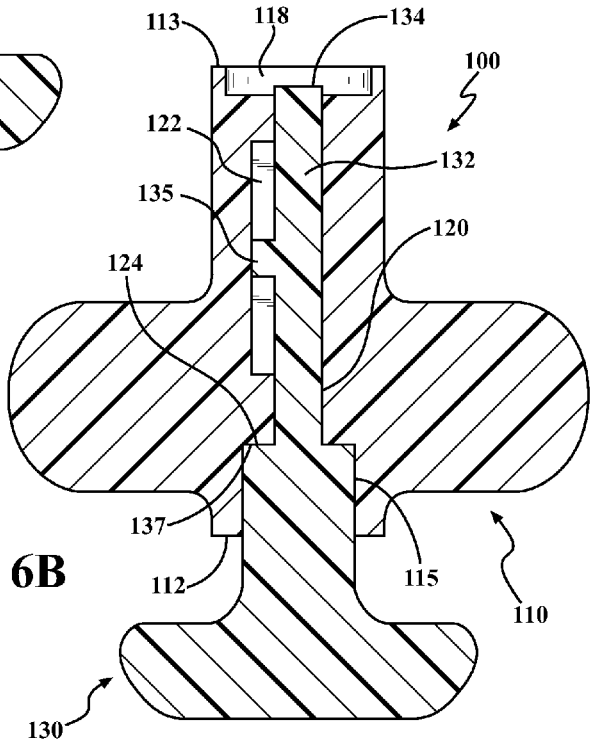
FIG. 6B is cross-sectional view of the clip installation tool, showing the plunger element in an extended position.

FIG. 6B shows an example of the plunger element 130 in an extended position. In the extended position, a portion of the shaft portion 132 including the distal end 134 is located within the clip receiving cavity 118. In such position, the distal end 134 of the shaft portion 132 can engage a portion of a clip received within the clip receiving cavity 118. In one or more arrangements, the distal end 134 does not extend beyond the second end 113 of the base element 110.

It will be appreciated that, in one or more arrangements, it may be desirable to control or limit the extended position of the plunger element 130. The controlling or limiting of the extended position may be desirable to prevent over engagement of the clip, which may damage or cause failure of the clip. The controlling or limiting of the extended position can be achieved in any suitable manner. For instance, the plunger insertion cavity 115 can be sized, shaped, and/or otherwise configured so that the shoulder 137 of the plunger element 130 engages the bottom wall 124 of the plunger insertion cavity 115. In this way, the maximum extended position of the plunger element 130 can be established.

The clip installation tool 100 can be used in connection with various fasteners. For instance, the clip installation tool 100 can be used in connection with a two-stage clip 190 (see FIG. 7). The two-stage clip 190 can be any suitable two-stage clip, now known of later developed. Generally, the two-stage clip 190 can have a first stage 194 and a second stage 192. The first stage 194 can be configured to be inserted into substantially aligned apertures (not shown) in two or more components. "Substantially aligned" means that the two apertures are positioned relative to each other such that a fastener (e.g., the first stage of a two-stage clip) can be received in both apertures at the same time. In one or more arrangements, one component can be a trim panel and another component can be a portion of a vehicle frame.

Figure 7:
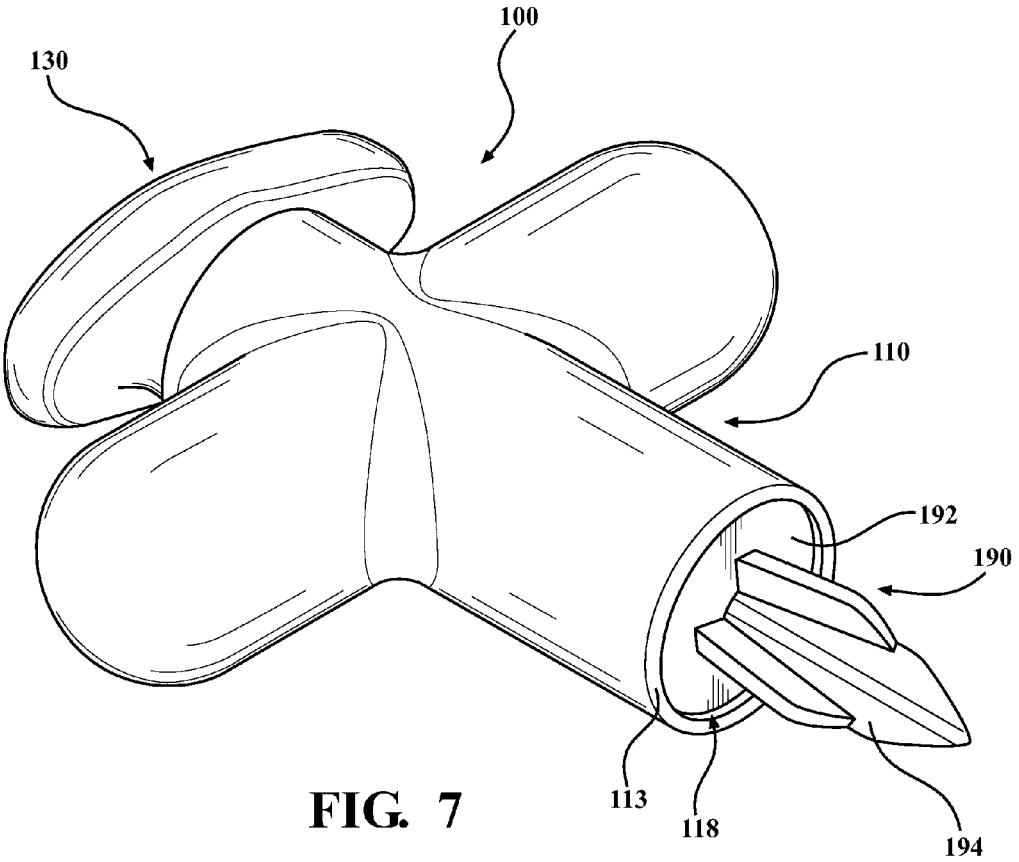
FIG. 7 is a view of the clip installation tool, showing a two-stage clip received in the clip receiving cavity.

The first stage 194 can be configured as an elongated protrusion, as is shown in FIG. 7. The second stage 192 can have any suitable form. In one or more arrangements, the second stage 192 can be generally circular. The second stage 192 can be engaged (e.g., pressed toward the first stage 194) to activate the first stage 194 of the two-stage clip 190. For instance, the second stage 192 can be pressed toward the first stage 194 to cause the first stage 194 to expand within the substantially aligned apertures and/or on an opposite side of the substantially aligned apertures from the second stage 192, thereby operatively connecting the two or more components.

Now that the various potential systems, devices, elements and/or components have been described, various methods for using the clip installation tool 100 will now be described. Various possible steps of method will now be described. The method described herein may be applicable to the embodiments described above in relation to FIGS. 1-7, but it is understood that the method can be carried out with other suitable systems and arrangements. Moreover, the method may include other steps that are not described here, and in fact, the method is not limited to including every step described herein. The steps that are mentioned here as part of the method are not limited to this particular chronological order. Indeed, some of the steps may be performed in a different order than what is shown and/or at least some of the steps shown can occur simultaneously.

The two-stage clip 190 and the clip installation tool 100 can be brought together such that at least a portion of the two-stage clip 190 is received in the clip receiving cavity 118. More particularly, at least the second stage 192 of the two-stage clip 190 can be received in the clip receiving cavity 118. In some instances, a portion of the first stage 194 of the two-stage clip 190 can also be received in the clip receiving cavity 118. The two-stage clip 190 can be retainably engaged within the clip receiving cavity 118 by the one or more protrusions 125. For example, the one or more protrusions 125 can directly contact the second stage 192 of the two-stage clip 190 and can retain the two-stage clip 190 by frictional engagement. With the two-stage clip 190 retainably engaged within the clip receiving cavity 118, a user can move the clip to a desired location.

The clip installation tool 100 and the substantially aligned apertures of two or more components of a vehicle can be brought together. As used herein, "vehicle" means any form of motorized transport. In one or more implementations, the vehicle can be an automobile. While arrangements will be described herein with respect to automobiles, it will be understood that embodiments are not limited to automobiles. In one or more implementations, the vehicle may be a watercraft, an aircraft or any other form of motorized transport.

In one or more arrangements, the clip installation tool 100 and the substantially aligned apertures of two or more components of a vehicle can be brought together by moving the clip installation tool 100 toward the substantially aligned apertures. The first stage 194 of the two-stage clip 190 can be inserted into the substantially aligned apertures. The clip installation tool 100 can be pushed toward the substantially aligned apertures to ensure that the first stage 194 is substantially fully inserted. In some instances, the second stage 192 of the two-stage clip 190 can contact one of the vehicle components being operatively connected to each other.

After the first stage 194 is inserted into the substantially aligned apertures of the vehicle components, the second stage 192 of the two-stage clip 190 can be engaged to activate the first stage 194. Such engagement can be achieved in any suitable manner. For instance, the clip installation tool 100 can be manipulated so that it is in the extended position. In such case, the distal end 134 of the plunger element 130 can directly contact the second stage 192 of the two-stage clip 190.

The plunger element 130 can be moved in this manner using only one hand. For instance, a user can grasp the handle 117 with his or her fingers while pushing the pad portion 131 toward the handle 117 using his or her palm. When the plunger element 130 engages the second stage 192, the first stage 194 can be activated such that the first stage the diameter and/or cross-sectional area of the first stage 194 increases, such as by deforming radially outward. In this way, the two or more vehicle components can be operatively connected to each other. The movement of the plunger element 130 can be limited by the bottom wall 124 of the plunger insertion cavity 115. In this way over engagement of the second stage 192 can be prevented.

The clip installation tool 100 can be separated from the two-stage clip 190 and withdrawn for other use. Such separation between the clip installation tool 100 and the two-stage clip 190 may occur automatically as a result of the plunger element 130 engaging the second stage 192. Otherwise, such separation can be achieved by pulling or otherwise moving the clip installation tool 100 away from the two-stage clip 190.

If it is desired to remove the two-stage clip 190 from the operatively connected two or more vehicle components, the two-stage clip 190 can be disengaged from the substantially aligned apertures by further engagement of the second stage 192. The clip installation tool 100 can be used to do so. For instance, the plunger element 130 can be separated from the base element 110. The distal end 134 of the plunger element 130 can be brought into direct contact with the second stage 192 of the two-stage clip 190. If sufficient force is applied to the second stage 192, the first stage 194 can revert to its previous state such that the diameter and/or cross-sectional area of the first stage 194 decreases. In such a condition, the two-stage clip 190 can be removed from the substantially aligned apertures by hand or using any suitable tool.

It will be appreciated that arrangements described herein can provide numerous benefits, including one or more of the benefits mentioned herein. For example, arrangements described herein can reduce or eliminate ergonomic strain on a human finger when installing a clip. In some instances, a higher force may be required to install the clip due to various reasons, such as the presence of burs or anomalies in the clip receiving passages of the trim and/or the other structure, misaligned parts, etc. Arrangements described herein can allow a clip to be retained in the clip installation tool prior to actual installation of the clip. As such, misplacing, dropping, and/or direct handling of the clip are minimized. Further, such a feature can facilitate transportation of the clip by a user. Arrangements described herein can facilitate a user's holding, handling, and/or manipulation of the clip. Indeed, some areas of a vehicle may be difficult to access and may impede manipulation of the clip by hand. Arrangements described herein can allow two stage clips to be installed without over engagement of the second stage, thereby preventing damage to or failure of the clip.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e. open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g. AB, AC, BC or ABC).

Aspects herein can be embodied in other forms without departing from the spirit or essential attributes thereof. Accordingly, reference should be made to the following claims, rather than to the foregoing specification, as indicating the scope of the invention.

What is claimed is:

1. A clip installation tool comprising:

a base element, the base element including a plunger insertion cavity and a clip receiving cavity, the base element including a connecting passage connecting between the plunger insertion cavity and the clip receiving cavity, the connecting passage including a keyway along a first portion of the length of the connecting passage, a first end of the keyway opening to the plunger insertion cavity, the connecting passage including a guide passage along a second portion of the length of the connecting passage, the guide passage being offset from the keyway, the guide passage being in communication with the keyway by a transfer passage in the base element, a second end of the keyway opening to the transfer passage; and a plunger element, at least a portion of the plunger element being retainably received in the base element, the plunger element being movable within the base element between a retracted position and an extended position, a portion of the plunger element extending into the clip receiving cavity in the extended position, the plunger element including a shaft portion having a retention element thereon, the plunger element having a longitudinal axis and a longitudinal direction, the keyway, the guide passage, and the transfer passage being configured to receive the retention element, when the retention element is received in the keyway or in the guide passage, the plunger element being movable substantially in the longitudinal direction, when the retention element is received in the transfer passage, the plunger element being selectively rotatable substantially about the longitudinal axis, whereby the retention element is selectively circumferentially movable within the transfer passage between the keyway and the guide passage.

2. The clip installation tool of claim 1, wherein the base element includes a handle.

3. The clip installation tool of claim 2, wherein the plunger element includes a pad portion and a shaft portion, and wherein the pad portion is transverse to the shaft portion.

4. The clip installation tool of claim 3, wherein, when the retention element is received in the guide passage, the handle and the pad portion extend in substantially the same direction.

5. The clip installation tool of claim 3, wherein the pad portion is configured for engagement by at least a portion of a human palm, and wherein the handle is configured for engaged by one or more human fingers.

6. The clip installation tool of claim 1, wherein the clip receiving cavity is configured to retainably engage a two-stage clip.

7. The clip installation tool of claim 1, wherein the base element and the plunger element are configured to establish a maximum extended position of the plunger element.

8. The clip installation tool of claim 7, wherein the plunger insertion cavity includes a wall, wherein the plunger element includes a shoulder, and wherein movement of the plunger element along a longitudinal axis of the plunger element is limited by contact between the wall and the shoulder.

9. A clip installation tool comprising:

a base element, the base element including a plunger insertion cavity and a clip receiving cavity, the clip receiving cavity being configured to retainably engage a two-stage clip having a first stage configured as an elongated protrusion and a second stage that is configured with a generally circular cross-sectional shape, the clip receiving cavity including a plurality of protrusions extending from an inner peripheral surface of the clip receiving cavity, the protrusions being configured to contact the second stage of the two-stage clip, whereby the plurality of protrusions retainably engage the two-stage clip; and a plunger element, at least a portion of the plunger element being retainably received in the base element, the plunger element being movable within the base element between a retracted position and an extended position, a portion of the plunger element extending into the clip receiving cavity in the extended position such that the plunger element contacts the second stage of the two-stage clip.

10. The clip installation tool of claim 9, wherein the base element includes a connecting passage connecting between the plunger insertion cavity and the clip receiving cavity, wherein the connecting passage including a keyway along at least a portion of its length, wherein the plunger element includes a shaft portion having a retention element thereon, wherein the plunger element having a longitudinal axis and a longitudinal direction, wherein the retention element is configured to be received in the keyway, and wherein, when the retention element is received in the keyway, the plunger element being movable substantially in the longitudinal direction.

11. The clip installation tool of claim 10, wherein the connecting passage includes a guide passage configured to receive the retention element, wherein the guide passage is offset from the keyway, wherein the guide passage is in communication with the keyway by a transfer passage in the base element, wherein, when the retention element is received in the guide passage, the plunger element being movable substantially in the longitudinal direction, and wherein, when the retention element is received in the transfer passage, the plunger element being rotatable substantially about the longitudinal axis, whereby the retention element is selectively movable circumferentially within the transfer passage between the keyway and the guide passage.

12. A clip installation tool comprising:

a base element, the base element including a handle, the base element including a plunger insertion cavity and a clip receiving cavity, the base element including a connecting passage connecting between the plunger insertion cavity and the clip receiving cavity, the clip receiving cavity being configured to retainably engage a two-stage clip having a first stage configured as an elongated protrusion and a second stage that is configured with a generally circular cross-sectional shape, the clip receiving cavity being substantially circular and configured to receive at least a portion of the second stage of the two-stage clip, the clip receiving cavity having an associated length; and a plunger element, at least a portion of the plunger element being retainably received in the base element, the plunger element being movable within the base element between a retracted position and an extended position, a portion of the plunger element extending into the clip receiving cavity in the extended position, and the plunger element including a pad portion and a shaft portion, the pad portion being transverse to the shaft portion, the base element and the plunger element being configured to establish a maximum extended position of the plunger element, and wherein, in the maximum extended position, the plunger element extends less than the entire length of the clip receiving cavity.

13. The clip installation tool of claim 12, wherein the pad portion is configured for engagement by at least a portion of a human palm, and wherein the handle is configured for engaged by one or more human fingers.

14. The clip installation tool of claim 12, wherein the connecting passage includes a keyway along at least a portion of its length, wherein the plunger element includes a shaft portion having a retention element thereon, wherein the plunger element having a longitudinal axis and a longitudinal direction, and wherein the retention element is configured to be received in the keyway, and wherein, when the retention element is received in the keyway, the plunger element being movable substantially in the longitudinal direction.

15. The clip installation tool of claim 14, wherein the base element includes a guide passage configured to receive the retention element, wherein the guide passage is offset from the keyway, wherein the guide passage is in communication with the keyway by a transfer passage in the base element, wherein, when the retention element is received in the guide passage, the plunger element being movable substantially in the longitudinal direction, and wherein, when the retention element is received in the transfer passage, the plunger element being rotatable substantially about the longitudinal axis, whereby the retention element is selectively movable circumferentially within the transfer passage between the keyway and the guide passage.

16. The clip installation tool of claim 12, wherein the clip receiving cavity includes a plurality of protrusions extending from an inner peripheral surface of the clip receiving cavity, wherein the protrusions being configured to contact the second stage of the two-stage clip, whereby the plurality of protrusions retainably engage a two-stage clip.

17. The clip installation tool of claim 12, wherein the plunger insertion cavity includes a wall, wherein the plunger element includes a shoulder, and wherein movement of the plunger element along a longitudinal axis of the plunger element is limited by contact between the wall and the shoulder.

* * * * *